US008811841B2

(12) United States Patent
Kinoshita et al.

(10) Patent No.: US 8,811,841 B2
(45) Date of Patent: Aug. 19, 2014

(54) FIXING DEVICE, IMAGE FORMING APPARATUS, AND NON-TRANSITORY COMPUTER READABLE MEDIUM

(75) Inventors: Shinichi Kinoshita, Kanagawa (JP); Hajime Kishimoto, Kanagawa (JP); Motofumi Baba, Kanagawa (JP); Shuichi Suzuki, Kanagawa (JP); Tsuyoshi Sunohara, Kanagawa (JP); Takeo Iwasaki, Kanagawa (JP); Takashi Ito, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 98 days.

(21) Appl. No.: 13/599,880

(22) Filed: Aug. 30, 2012

(65) Prior Publication Data

US 2013/0195492 A1 Aug. 1, 2013

(30) Foreign Application Priority Data

Jan. 26, 2012 (JP) ..... 2012-014517

(51) Int. Cl.
*G03G 15/20* (2006.01)

(52) U.S. Cl.
USPC ..... 399/69; 399/43; 399/88

(58) Field of Classification Search
CPC ... G03G 15/20; G03G 15/5004; G03G 15/80; G03G 2215/20; G03G 15/00
USPC ..... 399/69, 68, 67, 88, 37, 328, 329, 43
See application file for complete search history.

(56) References Cited

U.S. PATENT DOCUMENTS

| | | | | |
|---|---|---|---|---|
| 5,315,350 | A * | 5/1994 | Hirobe et al. | 399/69 |
| 2004/0042827 | A1* | 3/2004 | Izawa et al. | 399/328 |
| 2004/0165904 | A1* | 8/2004 | Tanaka | 399/69 |
| 2012/0114354 | A1* | 5/2012 | Saito et al. | 399/67 |
| 2012/0148282 | A1* | 6/2012 | Fukuzawa et al. | 399/69 |
| 2013/0195491 | A1* | 8/2013 | Suzuki et al. | 399/69 |

FOREIGN PATENT DOCUMENTS

JP 2003-307964 A 10/2003

* cited by examiner

*Primary Examiner* — Sophia S Chen
(74) *Attorney, Agent, or Firm* — Sughrue Mion, PLLC

(57) ABSTRACT

A fixing device includes a fixing unit, a power controller, a pressure applying unit, and a timing controller. The fixing unit fixes toner onto a recording medium transported in a determined transport direction, by using heat generated by a heat generator. The power controller controls supply of power for heating the fixing unit. The pressure applying unit applies pressure to the recording medium in a nip part formed between the pressure applying unit and the fixing unit. The timing controller controls the power controller to start supply of the power at a time which is a determined time period prior to an arrival time at which a leading edge of the recording medium in the transport direction arrives at the nip part.

10 Claims, 9 Drawing Sheets

FIXING DEVICE, IMAGE FORMING APPARATUS, AND NON-TRANSITORY COMPUTER READABLE MEDIUM

CROSS-REFERENCE TO RELATED APPLICATIONS

This application is based on and claims priority under 35 USC 119 from Japanese Patent Application No. 2012-014517 filed Jan. 26, 2012.

BACKGROUND (i) Technical Field

The present invention relates to a fixing device, an image forming apparatus, and a non-transitory computer readable medium.

(ii) Related Art

In image forming apparatuses, fixing devices consume a large amount of power to emit thermal energy. Techniques for reducing wasteful emission of thermal energy are available.

SUMMARY

According to an aspect of the invention, there is provided a fixing device including a fixing unit, a power controller, a pressure applying unit, and a timing controller. The fixing unit fixes toner onto a recording medium transported in a determined transport direction, by using heat generated by a heat generator. The power controller controls supply of power for heating the fixing unit. The pressure applying unit applies pressure to the recording medium in a nip part formed between the pressure applying unit and the fixing unit. The timing controller controls the power controller to start supply of the power at a time which is a determined time period prior to an arrival time at which a leading edge of the recording medium in the transport direction arrives at the nip part.

BRIEF DESCRIPTION OF THE DRAWINGS

An exemplary embodiment of the present invention will be described in detail based on the following figures, wherein.

DETAILED DESCRIPTION

Figure 1:
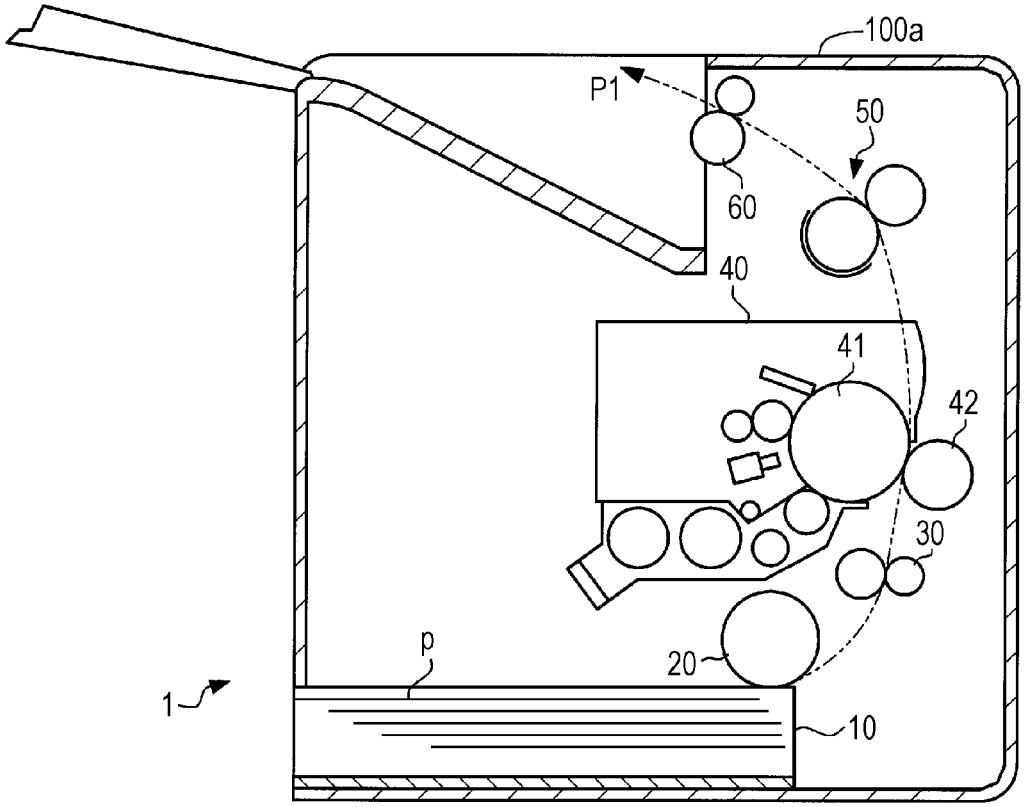
FIG. 1 schematically illustrates the internal configuration of an image forming apparatus.

FIG. 1 schematically illustrates an internal configuration of an image forming apparatus 1 according to an exemplary embodiment of the present invention. The image forming apparatus 1 may be an apparatus having functions of a copying machine, a printer, a scanner, a facsimile machine, and so forth. The image forming apparatus 1 has a housing 100*a* including a sheet accommodating section 10, a supply roller 20, transport rollers 30, a transfer section 40, a fixing section 50, and ejection rollers 60. The sheet accommodating section 10 accommodates sheets of paper p, which are examples of a recording medium. The supply roller 20 is brought into contact with each sheet of paper p accommodated in the sheet accommodating section 10, and supplies the sheet of paper p along a transport path P1. The transport rollers 30 transport the sheet of paper p supplied by the supply roller 20. The transport rollers 30 transport the sheet of paper p at the timing when the transfer section 40 forms a toner image. The transfer section 40 transfers a toner image onto the sheet of paper p transported by the transport rollers 30. The transfer section 40 includes a conductor 41 and a transfer roller 42. The transfer section 40 performs charging, exposure, and developing to form a toner image on the conductor 41. The transfer roller 42 transfers the toner image formed on the conductor 41 onto the sheet of paper p. The side of each sheet of paper p onto which the toner image is to be transferred (the side brought into contact with the conductor 41) is hereinafter referred to as the "front side" of the sheet of paper p. The fixing section 50, which is an example of a fixing device, fixes the toner image transferred by the transfer section 40 onto the sheet of paper p. The ejection rollers 60 eject the sheet of paper p onto which the toner image has been fixed from the image forming apparatus 1.

The image forming apparatus 1 further includes a controller, a communication section, a memory, and a power supply section, which are not illustrated in FIG. 1. The controller controls the operations of the individual components of the image forming apparatus 1 described above. The controller may be a computer including a central processing unit (CPU), a read only memory (ROM), and a random access memory (RAM). The communication section is connected to an external device such as a personal computer or a facsimile machine, and transmits and receives image data to from the external device. The memory includes a device that stores data and programs to be used by the controller, for example, a hard disk drive (HDD). The power supply section supplies power necessary to operate each of the components of the image forming apparatus 1. With the above configuration, the image forming apparatus 1 forms and fixes a toner image onto the front side of each sheet of paper p while transporting the sheet of paper p along the transport path P1. Hereinafter, the direction in which each sheet of paper p is transported is referred to simply as the "transport direction", and the direction perpendicular to the transport direction as the "widthwise direction". In addition, the length of each sheet of paper p in its width direction is hereinafter referred to as the "width of each sheet of paper p".

Figure 2:
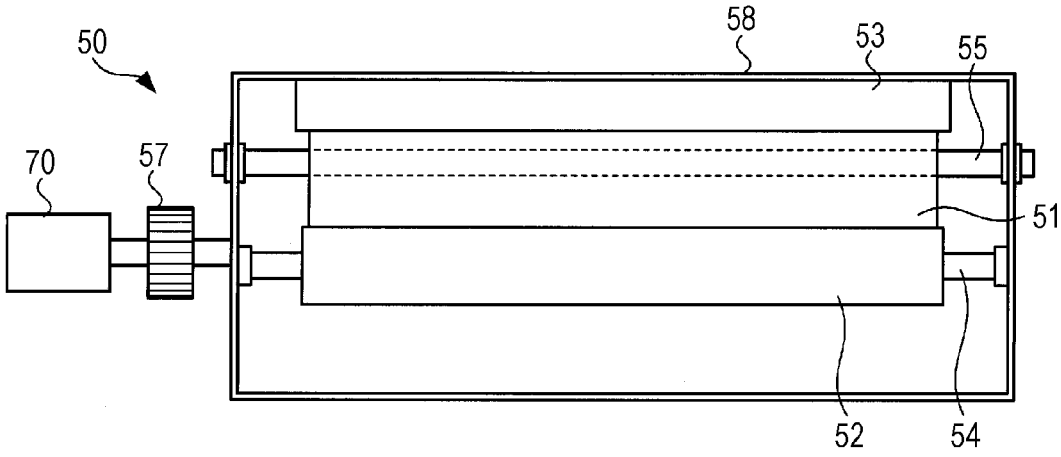
FIG. 2 is a cross-sectional view of a fixing section, when viewed from the upstream side in the transport direction.
Figure 3:
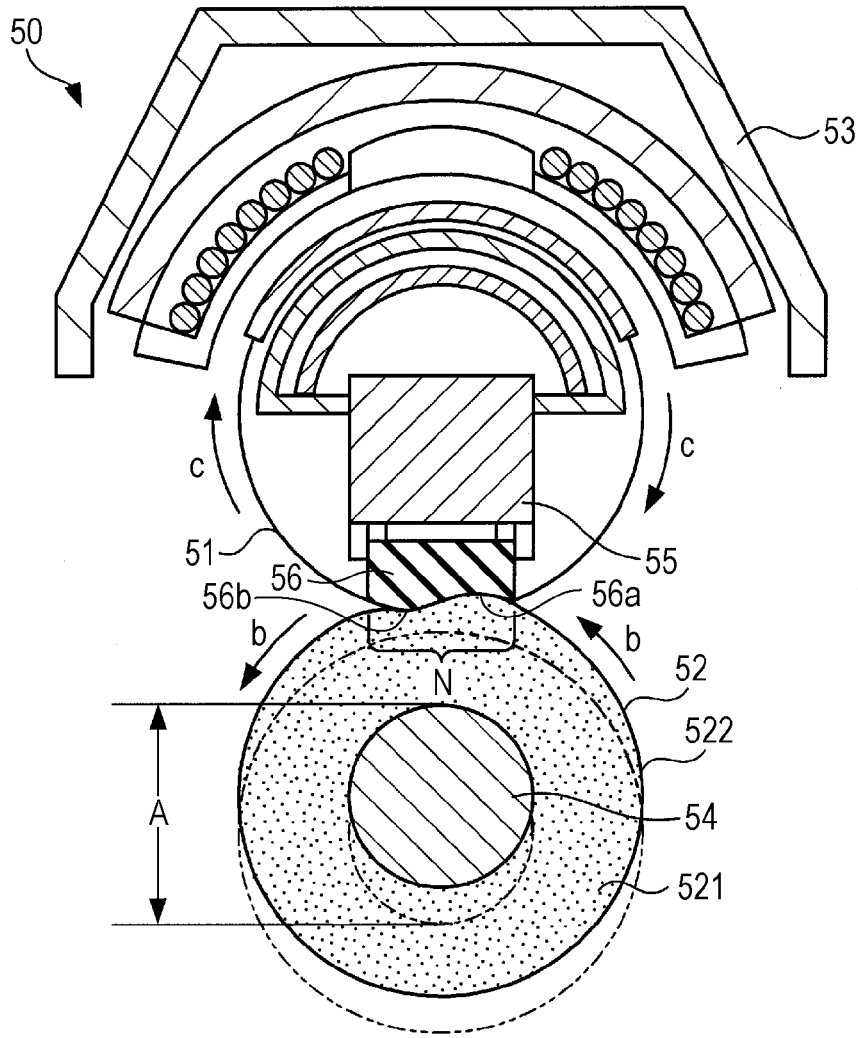
FIG. 3 is a cross-sectional view of the fixing section, when viewed from either side in the widthwise direction.

FIGS. 2 and 3 are cross-sectional views illustrating the internal configuration of the fixing section 50 according to an exemplary embodiment of the present invention. FIG. 2 is a view of the fixing section 50, when viewed from the upstream side in the transport direction of the sheets of paper p, and FIG. 3 is a view of the fixing section 50, when viewed from either side in the widthwise direction of the sheets of paper p. As illustrated in FIGS. 2 and 3, the fixing section 50 has a support member 58 including a fixing belt 51, a pressure roller 52, and an induction heating (IH) heater 53. The fixing belt 51 is an example of a fixing unit, the pressure roller 52 is an example of a pressure applying unit, and the IH heater 53 is an example of a magnetic field generation unit.

Figure 4:
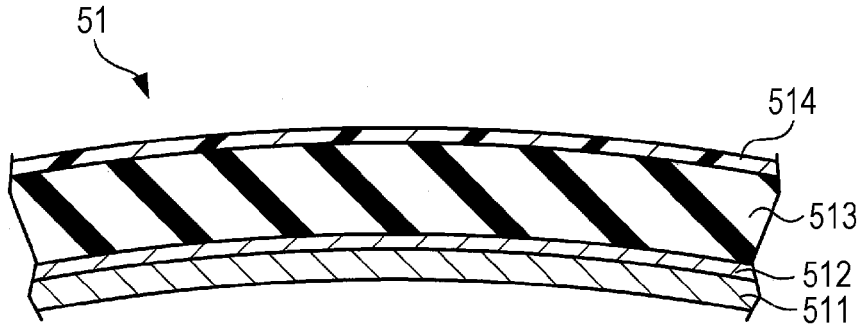
FIG. 4 is a cross-sectional view of a fixing belt.

FIG. 4 is a cross-sectional view of the fixing belt 51. The fixing belt 51 may be an endless belt member originally having a cylindrical shape, and may have, for example, a diameter of 30 mm and a length in the widthwise direction of 380 mm. The fixing belt 51 has a multi-layer structure including a base layer 511, a conductive heat generating layer 512, an elastic layer 513, and a surface release layer 514. The base layer 511 is formed of a heat-resistant sheet-shaped member that supports the conductive heat generating layer 512, which is a thin layer, and that achieves the mechanical strength of the overall fixing belt 51. The base layer 511 is further formed of such a material and has such a thickness that properties are achieved which allow a magnetic field to pass therethrough (relative permeability, specific resistance). That is, the base layer 511 does not, or is unlikely to, generate heat upon being acted upon by a magnetic field. Specifically, the base layer 511 is formed of, for example, a nonmagnetic metal material such as nonmagnetic stainless steel having a thickness of 30 μm or more and 200 μm or less, a resin material having a thickness of 60 μm or more and 200 μm or less, or any other suitable material. The conductive heat generating layer 512, which is an example of a heat generator, is a layer inductively heated by an alternating magnetic field generated by the IH heater 53. The conductive heat generating layer 512 is a layer through which an alternating magnetic field passes in the thickness direction and in which as a result eddy currents flow. The frequency of the alternating magnetic field may be, for example, 20 kHz or more and 100 kHz or less. The conductive heat generating layer 512 is configured such that an alternating magnetic field with a frequency of 20 kHz or more and 100 kHz or less enters and passes therethrough. Examples of the material of the conductive heat generating layer 512 may include elemental metals such as Au, Ag, Al, Cu, Zn, Sn, Pb, Bi, Be, and Sb, and an alloy thereof. Specifically, the conductive heat generating layer 512 may be formed of a nonmagnetic metal (paramagnetic material having a relative permeability of approximately 1), such as Cu, having a thickness of 2 μm or more and 20 μm or less and a specific resistance of 2.7×10-8 Ω·m or less. In order to reduce the time period (hereinafter referred to as the "warm-up time") required for the fixing belt 51 to be heated up to the temperature necessary to fix a toner image to each sheet of paper p (hereinafter referred to as the "fixing temperature"), the conductive heat generating layer 512 is formed thin to reduce the thermal capacity. The elastic layer 513 is formed of a heat-resistant elastic body of silicone rubber or the like. The elastic layer 513 deforms in accordance with the irregularities of the toner image transferred onto the sheet of paper p to uniformly supply heat to the toner image. For example, the elastic layer 513 may be formed of silicone rubber having a thickness of 100 μm or more and 600 μm or less and a hardness of 10° or more and 30° or less (JIS-A). Since the surface release layer 514 is brought into direct contact with an unfixed toner image that is held on a sheet of paper p, the surface release layer 514 may be formed of a material having high toner releasability. Examples of the material of the surface release layer 514 may include tetrafluoroethylene-perfluoroalkyl vinyl ether copolymer (PFA), polytetrafluoroethylene (PTFE), silicone copolymer, and a composite layer thereof. If the surface release layer 514 is too thin, the surface release layer 514 may become insufficient in terms of abrasion resistance, and the life of the fixing belt 51 may become short. If the surface release layer 514 is too thick, on the other hand, the thermal capacity of the fixing belt 51 may become too large, and the time required to reach the fixing temperature may become long. Accordingly, in terms of the balance between abrasion resistance and thermal capacity, the thickness of the surface release layer 514 may be set to, for example, 1 μm or more and 50 μm or less.

Referring back to FIG. 3, the fixing belt 51 fixes the toner image onto the sheet of paper p by means of the heat generated from the conductive heat generating layer 512. The pressure roller 52 applies pressure to the sheet of paper p in a nip part N formed between the pressure roller 52 and the fixing belt 51. The pressure roller 52 is disposed so as to face the fixing belt 51. The IH heater 53 generates an alternating magnetic field for causing the conductive heat generating layer 512 of the fixing belt 51 to generate heat through electromagnetic induction. The fixing belt 51 includes a pressing pad 56 inside its cylindrical shape. The pressing pad 56 may be formed of an elastic body of silicone rubber, fluororubber, or the like, and is supported by a holder 55 at the position facing the pressure roller 52. The pressing pad 56 is arranged so as to be pressed by the pressure roller 52 through the fixing belt 51, and the nip part N is formed between the pressing pad 56 and the pressure roller 52. Further, the pressing pad 56 has a pre-nip area **56*a* on the entrance side of the nip part N (or on the upstream side in the transport direction of the sheets of paper p) and a post-nip area or release nip area 56*b* on the exit side of the nip part N (or on the downstream side in the transport direction of the sheets of paper p). The pre-nip area 56*a* and the release nip area 56*b* are set to different nip pressures. The pre-nip area 56*a* is formed so as to have an arc shape which follows the outer peripheral surface of the pressure roller 52. The release nip area 56*b* is formed so as to be pressed with a locally high nip pressure from the surface of the pressure roller 52 so that the radius of curvature of the fixing belt 51 is reduced when the fixing belt 51 passes the release nip area 56*b*. The release nip area 56*b* allows the sheet of paper p that passes through the nip part N to be curled (down-curled) in a direction apart from the surface of the fixing belt 51 to facilitate the release of the sheet of paper p from the surface of the fixing belt 51**.

In addition, as illustrated in FIG. 2, in the fixing belt 51, both ends of the holder 55 in the widthwise direction are supported by the support member 58 so that the holder 55 rotates. When the fixing belt 51 and the pressure roller 52 are brought into contact with each other by a driving mechanism (not illustrated), the pressure roller 52 presses the fixing belt 51 across the entire width. Due to the frictional force between the fixing belt 51 and the pressure roller 52, the fixing belt 51 rotates so as to follow the pressure roller 52. When the pressure roller 52 is separated from the fixing belt 51 by the driving mechanism, the driving force fails and the fixing belt 51 stop its rotation.

Referring back to FIG. 3, the pressure roller 52 is a cylindrical member including an elastic layer 521 and a release layer 522. The elastic layer 521 may be heat-resistant and elastic, and may be formed of, for example, foamed silicone rubber or the like. The release layer 522 is a layer which is brought into contact with the sheets of paper p, and may be formed of a material having high releasability from the sheets of paper p. The release layer 522 may be, for example, a heat-resistant resin coating or a heat-resistant rubber coating such as a carbon-containing PFA coating. The release layer 522 may have a thickness of, for example, 50 μm. The pressure roller 52 may have, for example, a diameter of 28 mm and a length in the widthwise direction of 390 mm. The pressure roller 52 is arranged so as to extend along the holder 55 of the fixing belt 51, and moves in a direction indicated by an arrow A with respect to the fixing belt 51 by using the driving mechanism (not illustrated) to be brought into contact with or separated from the fixing belt 51.

As illustrated in FIG. 2, the pressure roller 52 has a rotating shaft 54 extending therethrough at the center of rotation thereof. Both ends of the rotating shaft 54 are supported by the support member 58 so that the rotating shaft 54 rotates. Both ends of the rotating shaft 54 are further supported so that the rotating shaft 54 may move within a predetermined range in the direction in which the fixing belt 51 is supported. A gear 57 is fixed to one end of the rotating shaft 54, and transmits a driving force from a driving motor 70 to the rotating shaft 54. Upon receiving a driving force, the pressure roller 52 rotates in a direction indicated by an arrow b in FIG. 3. In accordance with the rotation of the pressure roller 52, the fixing belt 51 also rotates in a direction indicated by an arrow c. When the fixing belt 51 and the pressure roller 52 rotate, the pressure roller 52 presses the fixing belt 51, and the nip part N is formed at the position where the pressure roller 52 is brought into contact with the fixing belt 51. When the sheet of paper p onto which a toner image has been transferred passes the nip part N, the toner image is fixed onto the sheet of paper p by heat and pressure.

Figure 5:
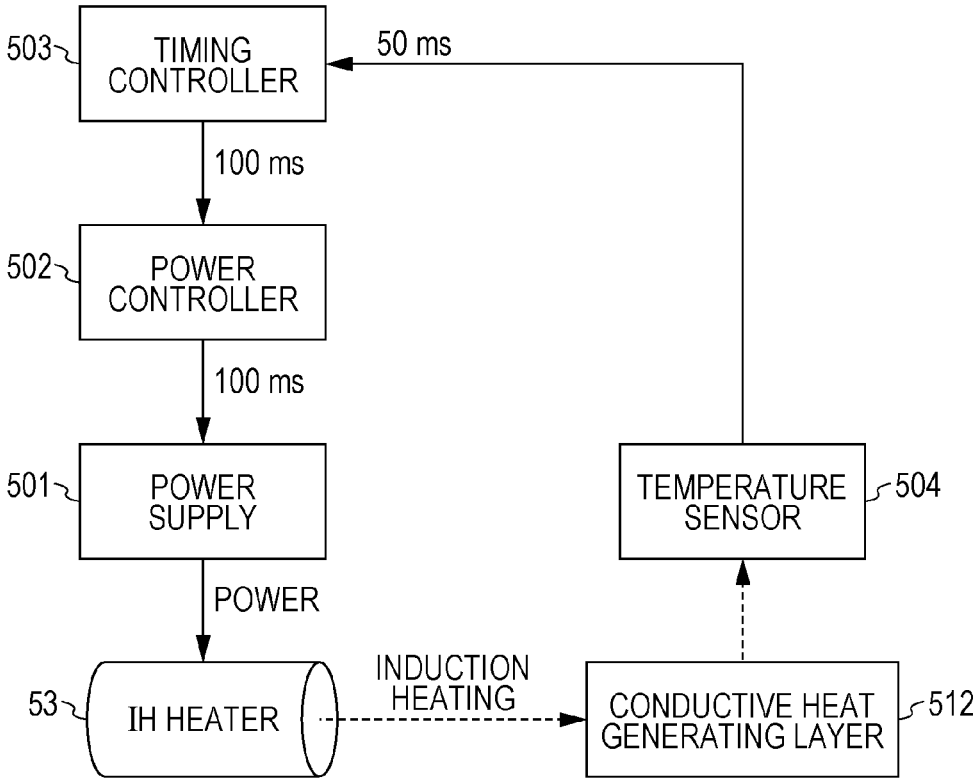
FIG. 5 is a block diagram illustrating a configuration for inductively heating a conductive heat generating layer.

FIG. 5 is a block diagram illustrating a configuration for inductively heating the conductive heat generating layer 512 in the fixing section 50. In FIG. 5, the fixing section 50 includes a power supply 501, a power controller 502, a timing controller 503, the IH heater 53, the conductive heat generating layer 512, and a temperature sensor 504, which is an example of a temperature detector. The power supply 501 supplies power to the IH heater 53. When power is supplied, the IH heater 53 generates an alternating magnetic field to inductively heat the conductive heat generating layer 512. The power controller 502 may be a computer including a CPU, a RAM, and a ROM, and controls power output from the power supply 501. The timing controller 503 may be a computer including a CPU, a RAM, and a ROM, and controls the power controller 502. The timing controller 503 outputs a signal indicating the start of power supply (hereinafter referred to as the "start signal") and a signal indicating the stop of power supply (hereinafter referred to as the "stop signal") to the power controller 502. The temperature sensor 504 detects the temperature of the conductive heat generating layer 512, and outputs the detected temperature to the timing controller 503. The temperature sensor 504 may be provided inside the cylindrical shape of the fixing belt 51. Upon acquiring the temperature of the conductive heat generating layer 512, the timing controller 503 newly generates a start signal or stop signal, and outputs the generated start signal or stop signal to the power controller 502.

In the illustrated example, the time required for the timing controller 503 to output a start signal or a stop signal is up to 100 ms. The time required for the power controller 502 to output a control signal for controlling the power supply 501 is also up to 100 ms. The timing controller 503 and the power controller 502 are independent from each other, and the output timings of the start and stop signals from the timing controller 503 and the power controller 502 may not be necessarily synchronized with each other. The timing controller 503 acquires the temperature of the conductive heat generating layer 512, which has been detected by the temperature sensor 504, at intervals of 50 ms. In view of the processing times of the power controller 502 and the timing controller 503 and the interval for acquiring the temperature, a response time period which is the time interval between the time point at which the timing controller 503 outputs a signal for controlling the power controller 502 and the time point at which the timing controller 503 acquires the temperature of the conductive heat generating layer 512 is up to 250 ms. This exemplary embodiment is based on the ideal conditions where the thermal capacity of the fixing belt 51 is zero and where the temperature of the conductive heat generating layer 512 reaches a maximum temperature Tm at the same time as when power is supplied. The response time period is determined when the power supply of the image forming apparatus 1 is turned on, and may vary depending on various conditions such as recovery from paper jam.

A power control strategy when the fixing section 50 fixes a toner image onto a sheet of paper p will be considered. If power supply by the power supply 501 is continued between the interval between the outgoing of a sheet of paper and the incoming of another sheet of paper, the power may be consumed even though no toner images are fixed. Thus, it may be desirable to reduce power consumption between the interval between the outgoing of a sheet of paper and the incoming of another sheet of paper. In the following description, a point in time at which the side of each sheet of paper p on its leading edge side in the transport direction arrives at the entrance of the nip part N is referred to as the "arrival time". In addition, a point in time at which the side of each sheet of paper p on its trailing edge in the transport direction passes the exit of the nip part N is referred to as the "passage time". If the timing controller 503 outputs a start signal at the arrival time and outputs a stop signal at the passage time, the timing at which the generation of a magnetic field by the IH heater 53 is switched on and off is delayed by the response time period described above with respect to the timing at which the sheet of paper p passes the nip part N. In an exemplary embodiment of the present invention, therefore, the following process is performed.

Figure 6:
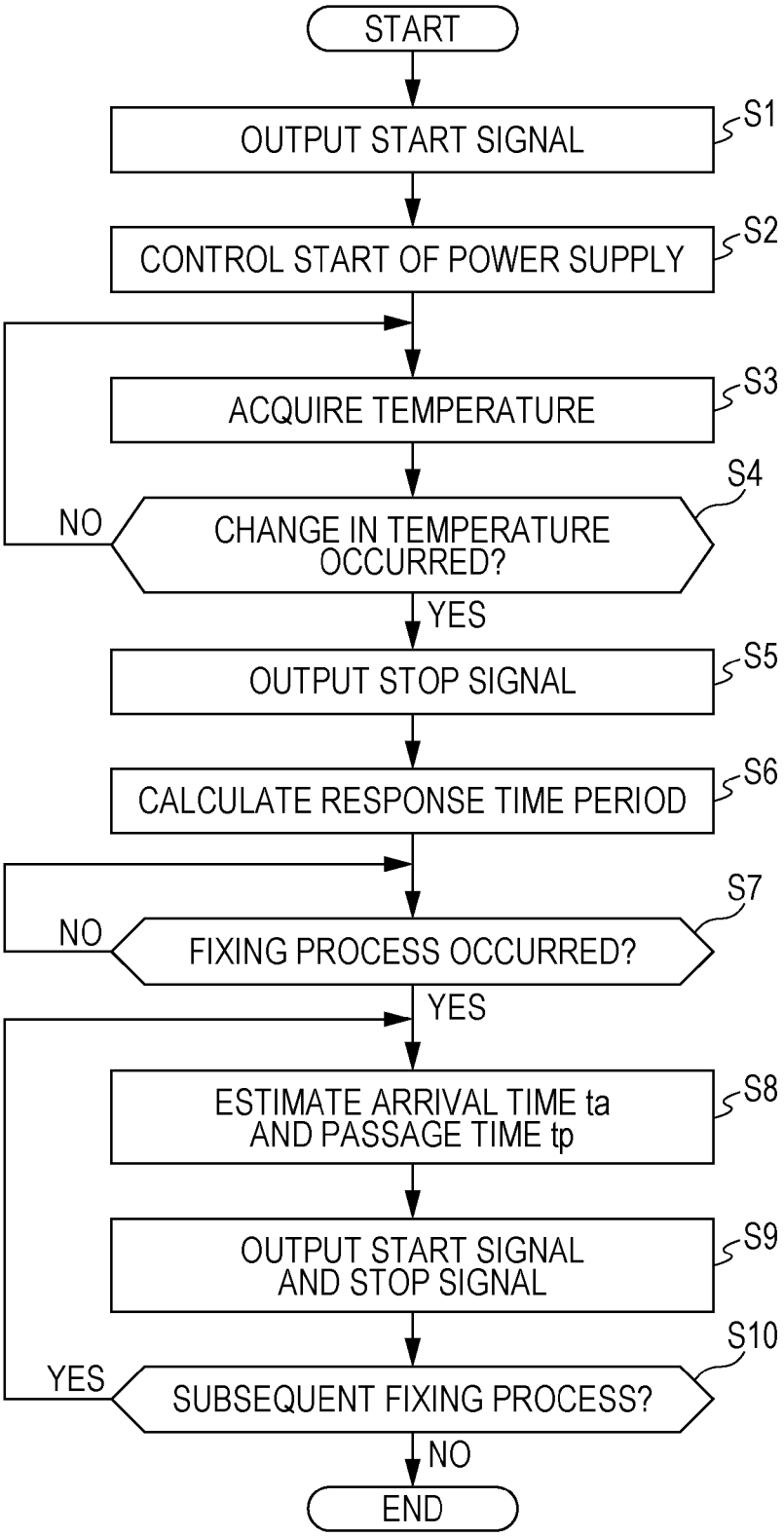
FIG. 6 is a flowchart illustrating the operation of the fixing section.

FIG. 6 is a flowchart illustrating the operation of the fixing section 50 according to an exemplary embodiment of the present invention. The processing of steps S1 to S6 is test processing for calculating a response time period, and no toner images are transferred or fixed. In the processing of steps S7 to S10, a toner image is transferred and fixed using the measured response time period. The following process is started when a trigger event occurs, for example, when the power supply of the image forming apparatus 1 is turned on. When the power supply of the image forming apparatus 1 is turned on, the timing controller 503 acquires the temperature of the conductive heat generating layer 512 before starting the following process. The timing controller 503 acquires the temperature Tg of the conductive heat generating layer 512 from the temperature sensor 504 at intervals of 50 ms, and stores the temperature Tg as a temperature T0 in the RAM. The temperature T0 is a reference temperature to determine whether a change in temperature has occurred, and may be equal to, for example, the temperature Tg obtained at a point in time which is one period ago (or 50 ms ago) or the average value of temperatures Tg obtained at multiple points in time which are one or more periods ago.

In step S1, the timing controller 503 outputs a start signal to the power controller 502. At this time, the timing controller 503 stores the output time point t0 when the timing controller 503 outputs the start signal in the RAM. When the start signal is input, the power controller 502 outputs a control signal for starting power supply to the power supply 501 (step S2). When power is supplied from the power supply 501, the IH heater 53 inductively heats the conductive heat generating layer 512. The induction heating allows the temperature of the conductive heat generating layer 512 to increase.

In step S3, the timing controller 503 acquires the temperature Tg of the conductive heat generating layer 512 from the temperature sensor 504. The timing controller 503 acquires the temperature Tg every 50 ms. Upon acquiring the temperature Tg from the temperature sensor 504, the timing controller 503 stores the temperature Tg in the RAM. Further, the timing controller 503 updates the temperature T0 on the basis of the acquired temperature Tg.

In step S4, the timing controller 503 determines whether or not the temperature Tg acquired from the temperature sensor 504 has changed from the temperature T0 by more than a determined value. Specifically, the timing controller 503 reads the temperature Tg and the temperature T0 from the RAM, and determines whether or not the temperature Tg is higher than the temperature T0 by a predetermined threshold Tth (e.g., 2° C.) or more. If it is determined that the temperature has changed by more than the determined value (YES in step S4), the timing controller 503 causes the process to proceed to step S5. At this time, the timing controller 503 stores the time point tx at which it is determined that the temperature has changed by more than the determined value in the RAM. If it is determined that the temperature has not changed by more than the determined value (NO in step S4), the timing controller 503 causes the process to return to step S3, and acquires a new temperature Tg.

In step S5, the timing controller 503 outputs a stop signal to the power controller 502. When the stop signal is input, the power controller 502 outputs a control signal for stopping power supply to the power supply 501. When power supply by the power supply 501 is stopped, the IH heater 53 stops induction heating of the conductive heat generating layer 512. As a result, the temperature of the conductive heat generating layer 512 decreases, and the temperature of the conductive heat generating layer 512 returns to the temperature T0.

In step S6, the timing controller 503 calculates a response time period tR, which is an example of a determined time period. The timing controller 503 reads the output time point t0 and the time point tx from the RAM, and calculates a response time period tR.

Figure 7:
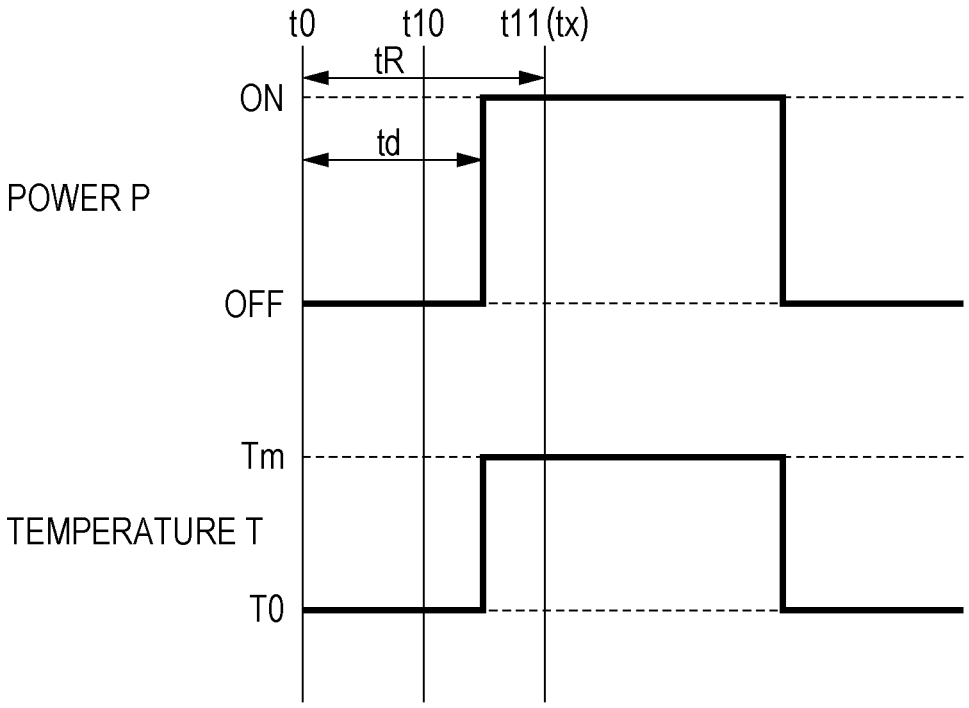
FIG. 7 illustrates measurement of a response time period.

FIG. 7 illustrates the response time period tR. Power P represents the power to be supplied from the power supply 501. Temperature T represents the temperature of the conductive heat generating layer 512. The horizontal axis represents time. At the output time point t0 at which the start signal is output, the power supply 501 is in an off state (no power being supplied), and the conductive heat generating layer 512 has the temperature T0. When a start signal is output at the output time point t0, the power supply from the power supply 501 to the IH heater 53 is started after a time period td has elapsed since the output time point t0 ("Power ON"). When power is supplied to the IH heater 53, the temperature of the conductive heat generating layer 512 increases. The magnitude of the power P is set to a value such that the maximum temperature Tm of the conductive heat generating layer 512 is larger than the fixing temperature.

The timing controller 503 acquires the temperature Tg of the conductive heat generating layer 512 every 50 ms, for example. Further, the timing controller 503 determines, using the acquired temperature Tg, whether or not the temperature of the conductive heat generating layer 512 has changed. In FIG. 7, the timing controller 503 determines at time point t10 and time point t11 whether or not the temperature Tg has changed from the temperature T0 by more than the determined value. At the time point t10, it is determined that the temperature of the conductive heat generating layer 512 has not changed (NO in step S4). At the time point t11, the temperature of the conductive heat generating layer 512 has reached the maximum temperature Tm, and it is thus determined that the temperature of the conductive heat generating layer 512 has changed by more than the determined value (YES in step S4). In FIG. 7, therefore, the time point t11 corresponds to the time point tx. In the illustrated example, it is assumed that the thermal capacity of the conductive heat generating layer 512 is zero. Thus, the time point tx is equivalent to a time point at which the temperature of the conductive heat generating layer 512 reaches the fixing temperature. In this case, the response time period tR is calculated from the elapsed time from the output time point t0 to the time point tx. That is, the response time period tR is calculated using formula (1) as follows:

$$tR=tx-t0. \quad (1)$$

Since temperatures are detected at predetermined intervals ti (e.g., ti=50 ms), there is a difference up to the value ti between the actual response time period td and the calculated response time period tR. That is, $$(tR-td)\leq ti. \quad (2)$$

Accordingly, the response time period tR is the time interval between the time point at which timing controller 503 outputs a start signal and the time point at which it is determined that the temperature of the conductive heat generating layer 512 has reached the fixing temperature. The timing controller 503 stores the calculated response time period tR in the RAM. Through the processing of steps S1 to S6, a response time period tR is determined in advance before a process for fixing a toner image onto a sheet of paper p (hereinafter referred to as the "fixing process") is started.

Referring back to FIG. 6, in step S7, the timing controller 503 determines whether or not the fixing process has occurred. The occurrence of the fixing process is identified by using a signal from the CPU in the image forming apparatus 1. If it is determined that the fixing process has occurred (YES in step S7), the timing controller 503 causes the process to proceed to step S8. If it is determined that the fixing process has not occurred (NO in step S7), the timing controller 503 causes the process to wait for the fixing process to occur.

In step S8, the timing controller 503 estimates the arrival time to at which the sheet of paper p will arrive at the nip part N and the passage time tp at which the sheet of paper p will pass the nip part N. The timing controller 503 acquires information indicating the position of the sheet of paper p from a position sensor (not illustrated). The position sensor may be included in, for example, the transport rollers 30, and detects the arrival and passage of each sheet of paper p at the transport rollers 30. The timing controller 503 estimates the arrival time ta and the passage time tp based on information indicating the position of the sheet of paper p which is acquired from the position sensor. In step S9, the timing controller 503 outputs a start signal and a stop signal. The timing controller 503 outputs a start signal at a time which is the response time period tR prior to the arrival time ta (i.e., ta−tR), and outputs a stop signal at a time which is the response time period tR prior to the passage time tp (i.e., tp−tR+ti). The last term ("+ti") in the time at which a stop signal is output is added in order to ensure that fixing is performed by the passage time. If this term is absent, due to the difference between the time period td and the response time period tR described with reference to FIG. 7, fixing may not be performed for the time period given by (tR−td).

In step S10, the timing controller 503 determines whether or not the subsequent fixing process is to be performed. If the subsequent fixing process is to be performed (YES in step S10), the timing controller 503 causes the process to return to step S8. If the subsequent fixing process is not to be performed (NO in step S10), the timing controller 503 ends the process.

Figure 8:
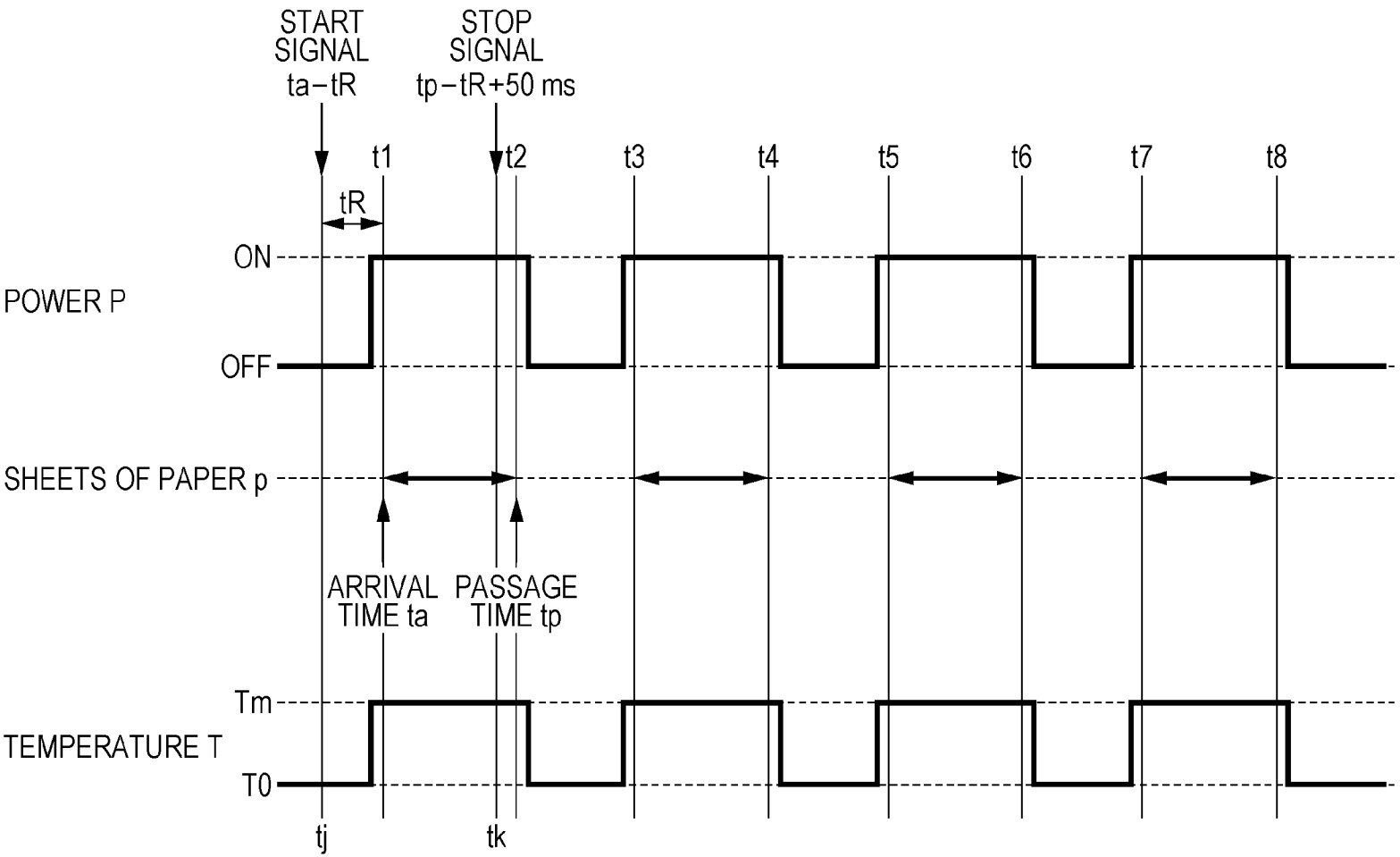
FIG. 8 is a timing chart illustrating a relationship between sheets of paper and an increase in temperature.

FIG. 8 is a timing chart illustrating, in the fixing process, a relationship between the time period for which each sheet of paper p passes the nip part N and an increase in the temperature of the conductive heat generating layer 512. The waveform of the power P supplied from the power supply 501 is represented as a square wave, and the power P supplied from the power supply 501 is switched on and off. The temperature T changes between the maximum temperature Tm and the temperature T0, which is lower than the fixing temperature, in accordance with the switching on and off of the power P. In FIG. 8, a fixing process is performed on four sheets of paper p, by way of example. In the "sheets of paper p" row, an arrow represents the time period for which each sheet of paper p passes the nip part N. The four sheets of paper p respectively pass the nip part N for the time periods from the time point t1 to the time point t2, from the time point t3 to the time point t4, from the time point t5 to the time point t6, and from the time point t7 to the time point t8. That is, the arrival times to of the sheets of paper p are t1, t3, t5, and t7, and the passage times tp of the sheets of paper p are t2, t4, t6, and t8. In FIG. 8, the timing controller 503 outputs start signals at time points tj, which are the response time period tR prior to the arrival times t1, t3, t5, and t7. As a result, the power supply from the power supply 501 is turned on by the arrival times t1, t3, t5, and t7, and the temperature T changes to the maximum temperature Tm. In addition, the timing controller 503 outputs stop signals at time points tk which are the response time period tR prior to the passage times t2, t4, t6, and t8. As a result, the power supply from the power supply 501 is turned off after the passage times t2, t4, t6, and t8 have passed, and the temperature T changes to the temperature T0. The temperature T is equal to the maximum temperature Tm for the time periods from the time point t1 to the time point t2, from the time point t3 to the time point t4, from the time point t5 to the time point t6, and from the time point t7 to t8 during which the sheets of paper p pass the nip part N. Thus, toner images are fixed onto the sheets of paper p. Furthermore, the power supply from the power supply 501 is turned off for the time periods from the time point t2 to the time point t3, from the time point t4 to the time point t5, and from the time point t6 to the time point t7 during which no sheets of paper p pass the nip part N. Thus, power consumption may be lower than that that when power supply is continued between the interval between the outgoing of a sheet of paper and the incoming of another sheet of paper.

Modifications

The present invention is not limited to the foregoing exemplary embodiment, and a variety of modifications may be made. Some modifications will be described. Two or more of the following modifications may be used in combination.

First Modification

The foregoing exemplary embodiment is based on the ideal condition where the thermal capacity of the fixing belt 51 is zero, by way of example. In actuality, however, the thermal capacity of the fixing belt 51 may not necessarily be zero and the change in the temperature T over time may not necessarily be represented as a complete square wave. That is, there may be a time lag between the time point at which power is supplied to the IH heater 53 and the time point at which the temperature of the conductive heat generating layer 512 reaches the maximum temperature Tm. If this time lag is taken into account, the method for calculating the response time period tR is not limited to that described in the foregoing exemplary embodiment.

Figure 9:
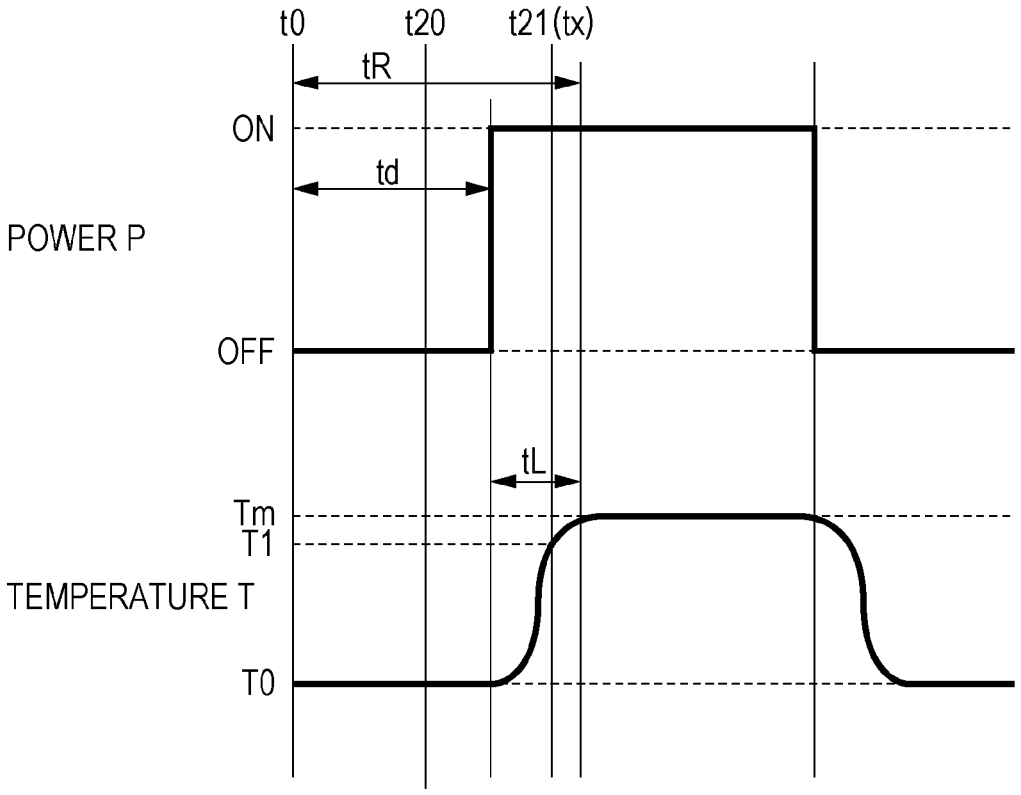
FIG. 9 illustrates a response time period according to a first modification.

FIG. 9 illustrates a response time period tR according to a first modification. Similarly to FIG. 7, a start signal is output at the output time point t0, and power is supplied from the power supply 501 after the time period td has elapsed since the output time point t0. When power is supplied, the temperature of the conductive heat generating layer 512 starts to increase. Since the fixing belt 51 has thermal capacity, as described above, there is a time lag tL until the temperature of the conductive heat generating layer 512 reaches the maximum temperature Tm from the temperature T0. In FIG. 9, the timing controller 503 determines whether the temperature Tg has changed from the temperature T0 at a time point t20 and a time point t21. At the time point t20, the conductive heat generating layer 512 has the temperature T0, and it is thus determined that the temperature of the conductive heat generating layer 512 has not changed (NO in step S4). At the time point t21, the conductive heat generating layer 512 has the temperature T1. In the illustrated example, it is assumed that (T1−T0)≥Tth, and it is determined that the temperature of the conductive heat generating layer 512 has changed from the temperature T0 by more than the determined value (YES in step S4). In FIG. 9, therefore, the time point t21 corresponds to the time point tx. The timing controller 503 estimates a response time period tR. The response time period tR may be estimated using, for example, the time point t0, the time point tx, the temperature T0, and the temperature Tg (in FIG. 9, the temperature T1). Specifically, the timing controller 503 estimates a response time period tR by substituting the time point t0, the time point tx, the temperature T0, and the temperature Tg into a formula representing a change in the temperature of the conductive heat generating layer 512 over time. The timing controller 503 outputs a start signal and a stop signal at the times described in the foregoing exemplary embodiment.

Figure 10:
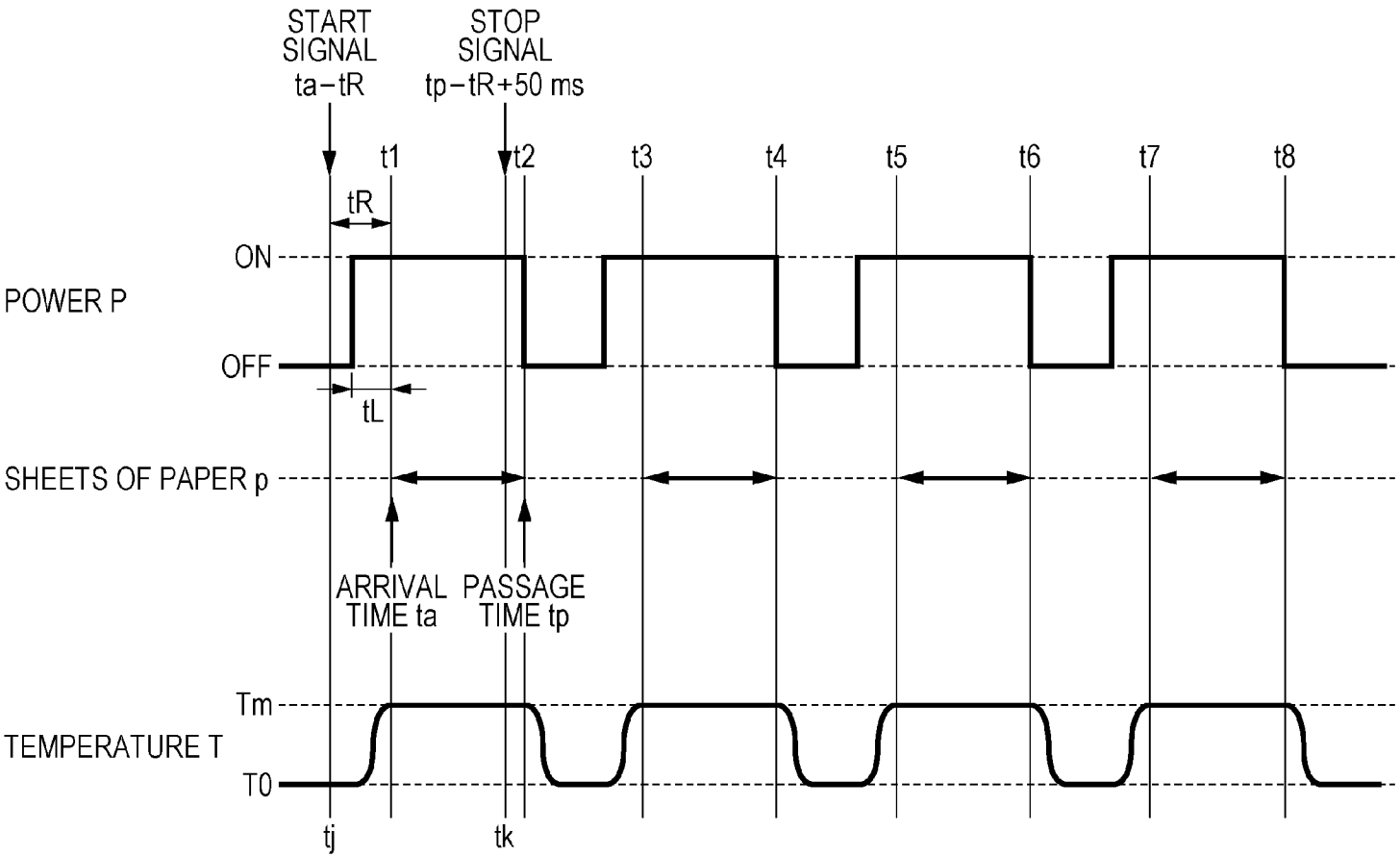
FIG. 10 is a timing chart illustrating a fixing process according to the first modification.

FIG. 10 is a timing chart illustrating a fixing process according to the first modification. In FIG. 10, the timing controller 503 outputs start signals at time points tj, which are the response time period tR prior to the arrival times t1, t3, t5, and t7. When start signals are output, the power supply from the power supply 501 is turned on at time points which are the time lag tL before the arrival times t1, t3, t5, and t7. When power supply is turned on, the temperature T of the conductive heat generating layer 512 reaches the maximum temperature Tm for a period equal to the time lag tL. As a result, the temperature T of the conductive heat generating layer 512 reaches the maximum temperature Tm at the arrival times t1, t3, t5, and t7. Furthermore, the timing controller 503 outputs stop signals at time points tk, which are the response time period tR prior to the passage times t2, t4, t6, and t8. When stop signals are output, the power supply from the power supply 501 is turned off at the passage times t2, t4, t6, and t8. When power supply is turned off, the temperature T of the conductive heat generating layer 512 changes to the temperature T0 for a period equal to the time lag tL. The first modification is based on the assumption that the rate of the reduction in the temperature of the conductive heat generating layer 512 over time is equal to the rate of the increase in the temperature of the conductive heat generating layer 512. In this manner, even if the fixing belt 51 has thermal capacity, power consumption may be lower than that when power supply is continued between the interval between the outgoing of a sheet of paper and the incoming of another sheet of paper.

Second Modification

In view of the thermal capacity of the fixing belt 51, the method for calculating the response time period tR is not limited to the method described in the first modification. The response time period tR may be calculated by directly measuring the time required for the temperature of the conductive heat generating layer 512 to reach the maximum temperature Tm. In this case, in step S4 of FIG. 6, the timing controller 503 determines whether or not the temperature Tg acquired from the temperature sensor 504 has reached the maximum temperature Tm.

Third Modification

In the foregoing exemplary embodiment, the response time period tR in the case where a start signal is output is calculated, and the response time period tR is used both when a start signal is output and when a stop signal is output. The response time period tR to be used to turn off power supply may be different from the response time period tR to be used to turn on power supply. For example, if the rate of the reduction in the temperature of the conductive heat generating layer 512 over time is lower than the rate of the increase in the temperature of the conductive heat generating layer 512, the response time period tR to be used to turn off power supply may be longer than the response time period tR to be used to turn on power supply. Conversely, if the response time period tR to be used to turn off power supply may be shorter than the response time period tR to be used to turn on power supply.

Fourth Modification

The response time periods tR may be measured individually when a start signal is output and when a stop signal is output. The response time period tR to be measured when a stop signal is output is the time interval between, for example, the time point at which the timing controller 503 outputs a stop signal and the time point at which it is determined that the temperature of the conductive heat generating layer 512 is lower than the temperature T0 by more than a determined value. In this case, in step S6 of FIG. 6, the timing controller 503 calculates the response time period tR for the start signal and the response time period tR for the stop signal. In step S9, the timing controller 503 outputs a start signal at a time which is the response time period tR for the start signal prior to the arrival time ta and outputs a stop signal at a time which is the response time period tR for the stop signal prior to the passage time tp.

Fifth Modification

In the fixing process, a response time period may not necessarily be used for both the output of a start signal and the output of a stop signal. The response time period tR may be used for either the output of a start signal or the output of a stop signal. For example, a start signal may be output with the response time period tR, and a stop signal may be output at the passage time tp.

Sixth Modification

The calculation of the response time period tR may not necessarily be started when, as a trigger event, the power supply is turned on. The response time period tR may be calculated at any time before the fixing process is performed. For example, when the fixing process is repeatedly performed, the response time period tR may be calculated between consecutive fixing processes. In this case, the timing controller 503 may calculate the response time period tR when the temperature of the conductive heat generating layer 512 is lower than a determined temperature in order to prevent the conductive heat generating layer 512 from performing excessive heating.

Seventh Modification

The response time period tR may be calculated more than once. The response time period tR may be performed and updated multiple times. For example, if the response time period tR is calculated between a certain fixing process and the subsequent fixing process and the difference between the newly calculated response time period tR and the original response time period tR is larger than a predetermined value, the response time period tR may be updated. In another example, the response time period tR may be calculated during the fixing process. In this case, the timing controller 503 measures the time interval between the time point at which a start signal is output and the time point at which a temperature greater than or equal to a predetermined temperature is acquired from the temperature sensor 504, and calculates the response time period tR.

Eighth Modification

The power supply from the power supply 501 may not necessarily be turned off between the interval between the outgoing of a sheet of paper and the incoming of another sheet of paper. The power supply from the power supply 501 may be turned off, for example, between the interval between the outgoing of an image area with a toner image transferred thereon and the incoming of another image area with a toner image transferred thereon. In this case, in step S8 of FIG. 6, the timing controller 503 acquires, as an arrival time ta, the time point at which an image area on a sheet of paper p arrives at the nip part N, and acquires, as a passage time tp, the time point at which the image area on the sheet of paper p passes the nip part N.

Ninth Modification

The configuration for performing induction heating on the conductive heat generating layer 512 is not limited to that illustrated in FIG. 5. For example, some of or all the functions of the timing controller 503 may be performed by the controller of the image forming apparatus 1.

Tenth Modification

The present invention may also be implemented as a program for causing a computer in the image forming apparatus 1 or the fixing device described above (i.e., the fixing section 50) to execute the process illustrated in FIG. 6. This program may be stored and provided on a computer-readable recording medium such as a magnetic recording medium (e.g., a magnetic tape or a magnetic disc (an HDD, a flexible disk (FD))), an optical recording medium (e.g., an optical disc (a compact disk (CD) or a digital versatile disk (DVD))), a magneto-optical recording medium, or a semiconductor memory (e.g., a flash ROM). The program may also be downloaded via a network such as the Internet.

Eleventh Modification

The fixing unit is not limited to the fixing belt 51. The fixing unit may have, for example, a heat accumulation plate that is heated through electromagnetic induction to implement high productivity. The heat accumulation plate is a member formed of a temperature-sensitive magnetic alloy and disposed in contact with the fixing belt 51 along the inner circumferential surface of the fixing belt 51. The thickness and material of the heat accumulation plate are adjusted so that heat is generated through electromagnetic induction in the alternating magnetic field generated by the IH heater 53. The heat generated from the heat accumulation plate is supplied to the fixing belt 51. In this manner, a fixing device including a heat accumulation plate may allow the fixing belt 51 to be warmed by the heat generated from the heat accumulation plate as well as the heat generated from the fixing belt 51. Thus, such a fixing device may prevent the reduction in the temperature of the fixing belt 51 while increasing the efficiency of electromagnetic induction heating by the IH heater 53, thereby yielding high productivity.

In another example, the fixing unit may not necessarily have a belt shape but may have a roll shape.

In still another example, the fixing belt 51 may have a single-layer configuration having a single material. For example, the fixing belt 51 may have a single layer formed of a metal, such as Ni, having a thickness of approximately 50 μm.

Other Modifications

The processes performed by the power controller 502 and the timing controller 503 may be performed by a single controller. In addition, some of or all the functions of the power controller 502 and the timing controller 503 may be implemented by the controller of the image forming apparatus 1.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing unit configured to fix toner onto a recording medium transported in a determined transport direction, by using heat generated by a heat generator;

a power controller configured to control supply of power for heating the fixing unit;

a pressure applying unit configured to apply pressure to the recording medium in a nip part formed between the pressure applying unit and the fixing unit; and a timing controller configured to control starting or stopping of the power controller according to a determined time period with respect to an arrival time or a passage time of the recording medium, wherein the determined time period is determined in accordance with a time period from an output time point at which the timing controller outputs a signal for controlling the power controller to a time point at which the timing controller determines that a temperature of the heat generator has changed from a reference temperature by more than a determined value.

2. The fixing device according to claim 1, wherein the timing controller is configured to control the power controller to stop supply of the power at a time which is a determined time period prior to the passage time at which a trailing edge of the recording medium in the transport direction passes the nip part.

3. The fixing device according to claim 1, further comprising a magnetic field generation unit configured to generate an alternating magnetic field for causing the heat generator to generate heat through electromagnetic induction, wherein the power controller is configured to control supply of power to the magnetic field generation unit.

4. The fixing device according to claim 1, further comprising a temperature detector configured to detect the temperature of the heat generator, wherein the timing controller is configured to acquire the temperature of the heat generator from the temperature detector.

5. The fixing device according to claim 1, wherein the determined time period is determined in advance before the fixing unit starts fixing toner.

6. An image forming apparatus comprising:

a transfer section configured to transfer a toner image onto a recording medium; and the fixing device according to claim 1, the fixing device configured to fix toner onto the recording medium onto which the toner image has been transferred by the transfer section.

7. The fixing device according to claim 1, wherein the timing controller is configured to control the power controller to start supply of the power at a time which is a determined time period prior to the arrival time at which a leading edge of the recording medium in the transport direction arrives at the nip part.

8. A non-transitory computer readable medium storing a program causing a computer to execute a process, the process comprising:

fixing toner onto a recording medium transported in a determined transport direction, by using heat generated by a heat generator;

controlling supply of power for heating the fixing unit;

applying pressure to the recording medium in a nip part; and controlling supply of power by a timing controller to start or stop the power according to a determined time period with respect to an arrival time or a passage time of the recording medium, wherein the determined time period is determined in accordance with a time period from an output time point at which the timing controller outputs a signal for controlling the power to a time point at which the timing controller determines that a temperature of the heat generator has changed from a reference temperature by more than a determined value.

9. A fixing device comprising:

a fixing unit configured to fix toner onto a recording medium transported in a determined transport direction, by using heat generated by a heat generator;

a power controller configured to control supply of power for heating the fixing unit;

a pressure applying unit configured to apply pressure to the recording medium in a nip part formed between the pressure applying unit and the fixing unit;

a temperature detector that detects a temperature of the heat generator; and a timing controller configured to control the power controller to start supply of the power at a time which is a determined time period prior to an arrival time at which a leading edge of the recording medium in the transport direction arrives at the nip part, wherein the timing controller acquires the temperature of the heat generator from the temperature detector, and wherein the determined time period is determined in accordance with a time period from an output time point at which the timing controller outputs a signal for controlling the power controller to a time point at which the timing controller determines that the temperature of the heat generator has changed from a temperature used as a reference by more than a determined value.

10. A fixing device comprising:

a fixing unit configured to fix toner onto a recording medium transported in a determined transport direction, by using heat generated by a heat generator;

a power controller configured to control supply of power for heating the fixing unit;

a pressure applying unit configured to apply pressure to the recording medium in a nip part formed between the pressure applying unit and the fixing unit;

a temperature detector that detects a temperature of the heat generator; and a timing controller configured to control the power controller to stop supply of the power at a time which is a determined time period prior to a passage time at which a trailing edge of the recording medium in the transport direction passes the nip part, wherein the timing controller acquires the temperature of the heat generator from the temperature detector, and wherein the determined time period is determined in accordance with a time period from an output time point at which the timing controller outputs a signal for controlling the power controller to a time point at which the timing controller determines that the temperature of the heat generator has changed from a temperature used as a reference by more than a determined value.

* * * * *